US007116929B2

(12) United States Patent
Yamada

(10) Patent No.: US 7,116,929 B2
(45) Date of Patent: Oct. 3, 2006

(54) DEVELOPER SUPPLY CONTAINER INCLUDING PLATE-LIKE MEMBER WHICH CAN BE EASILY AND SOLIDLY FIXED TO INTERIOR OF THE CONTAINER

(75) Inventor: Yusuke Yamada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 10/833,117

(22) Filed: Apr. 28, 2004

(65) Prior Publication Data

US 2005/0013635 A1 Jan. 20, 2005

(30) Foreign Application Priority Data

May 1, 2003 (JP) ..... 2003-126509

(51) Int. Cl.
*G03G 15/08* (2006.01)

(52) U.S. Cl. ..... 399/262; 399/263

(58) Field of Classification Search ..... 399/258, 399/262, 263
See application file for complete search history.

(56) References Cited

U.S. PATENT DOCUMENTS 5,675,893 A 10/1997 Yamada et al. ..... 29/895.22
5,907,750 A 5/1999 Yamada et al. ..... 399/116
5,991,571 A 11/1999 Yamada et al. ..... 399/117
6,389,257 B1 * 5/2002 Harumoto et al. ..... 399/262
6,944,417 B1 * 9/2005 Yamada et al. ..... 399/263
2002/0122676 A1 9/2002 Yamada et al. ..... 399/263
2003/0081967 A1 5/2003 Yoshikawa et al. ..... 399/258

FOREIGN PATENT DOCUMENTS

JP 2003-57931 2/2003

* cited by examiner

*Primary Examiner*—William J. Royer
(74) *Attorney, Agent, or Firm*—Fitzpatrick, Cella, Harper & Scinto

(57) ABSTRACT

A developer supply container is detachably mountable to an image forming apparatus. The the developer supply container includes: a container body for containing a developer; a discharge opening for permitting discharge of the developer from an inside of the container body; a plate-like member having a feeding portion for feeding the developer in the container body toward the discharge opening with rotation of the container body; a pair of nipping portions, provided on an inner surface at one longitudinal end of the container body, for nipping the plate-like member inserted from the other longitudinal end of the container body; and a guide portion, provided between the nipping portions, for guiding insertion of the plate-like member.

11 Claims, 11 Drawing Sheets

DEVELOPER SUPPLY CONTAINER INCLUDING PLATE-LIKE MEMBER WHICH CAN BE EASILY AND SOLIDLY FIXED TO INTERIOR OF THE CONTAINER

FIELD OF THE INVENTION AND RELATED ART

The present invention relates to a developer supply container employed by an electrophotographic or electrostatic image forming apparatus. In particular, it relates to a developer supply container employed by an image forming apparatus such as a copying machine, a printer, and a facsimile machine.

Developer in the form of particulates has long been used as developer (which hereinafter may be referred to simply as toner) for an image forming apparatus, such as an electrophotographic copying machine or printer. Further, it has been a common practice that as the amount of the developer in the main assembly of an image forming apparatus is reduced to a critical value by consumption, the main assembly is supplied with toner, with the use of a developer supply container (which hereinafter will be referred to as a toner supply container, or simply as a toner container).

Toner is in the form of extremely small particulates. Therefore, it has been a problem that toner scatters, contaminating the adjacencies of an image forming apparatus inclusive of an operator, during a toner replenishment operation. Thus, a number of proposals for solving this problem have been made, and some of them have been put to practical use.

According to these proposals, a toner supply container is placed in the main assembly of an image forming apparatus (which hereinafter may be simply called "apparatus main assembly"), and the toner therein is incrementally discharged through the small opening of the container.

As an example of a toner container of the above mentioned type, which is left in the main assembly of an image forming apparatus, there is the developer supply container disclosed in the following patent document (Document 1).

The developer supply container disclosed in Japanese Laid-open Patent Application 2003-57931 is roughly cylindrical in overall shape, and is provided with a relatively small developer outlet, which is located at one of the lengthwise ends of the container. It is provided with a member comprising a portion in the form of a piece of flat plate, and a plurality of slanted ribs attached to the flat portion so that as the developer container is rotated, the developer therein is conveyed toward the developer outlet of the container. This member is placed in the container, in a manner to divide the internal space of the container into two halves. The flat portion of this member is also provided with a plurality of through holes for improving the developer stirring effect of the member. With the provision of the above described structural arrangement, the developer in the developer supply container is smoothly conveyed toward the developer outlet while being increased in fluidity.

However, a developer supply container such as the above described one has the following problem. That is, when a developer supply container is assembled during the manufacture thereof, the flat portion of the member, which is virtually the same in length as that of the developer supply container, must be inserted into the developer supply container, and solidly fixed to the container. Therefore, it is possible that not only will the time required for the insertion and fixation of the member become substantial, but also, the amount of labor required of assembly workers will become substantial.

SUMMARY OF THE INVENTION

The primary object of the present invention is to provide a developer supply container, the developer conveying member of which can be easily and solidly fixed to the interior of the developer supply container.

According to an aspect of the present invention, there is provided a developer supply container detachably mountable to an image forming apparatus, the developer supply container comprising a container body for containing a developer; a discharge opening for permitting discharge of the developer from inside of said container body; a plate-like member having a feeding portion for feeding the developer in the container body toward the discharge opening with rotation of the container body; a pair of nipping portions, provided on an inner surface at one longitudinal end of the container body, for nipping the plate-like member inserted from the other longitudinal end of the container body; and a guide portion, provided between the nipping portions, for guiding insertion of the plate-like member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the toner supply container and image forming apparatus in accordance with the present invention will be described in more detail with reference to the appended drawings.

First, an electrophotographic image forming apparatus, as an example of an image forming apparatus compatible with the toner supply container in accordance with the present invention, will be described regarding the structure thereof with reference to FIG. 1.

(Electrophotographic Image Forming Apparatus)

Figure 1:
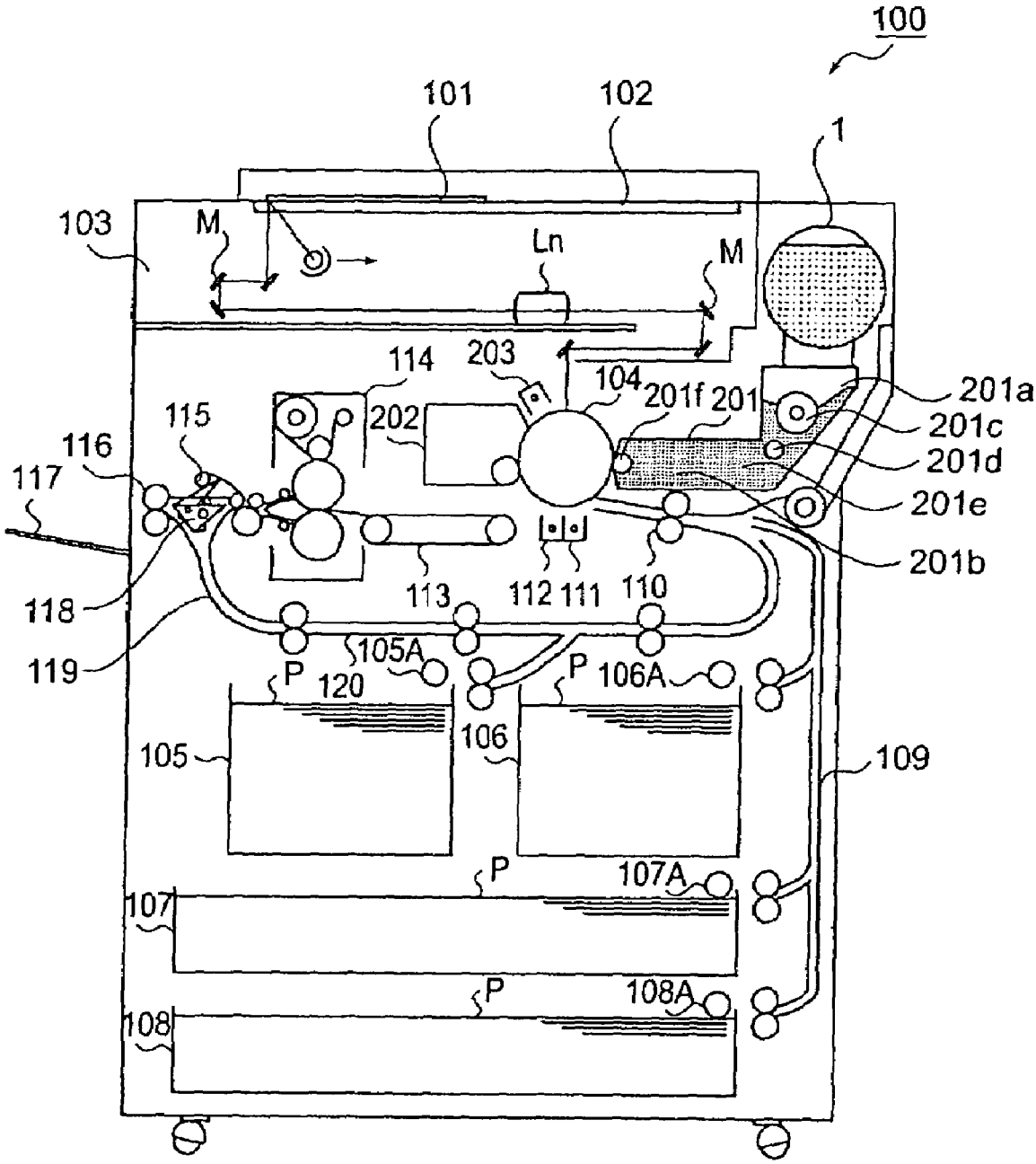
FIG. 1 is a schematic vertical sectional view of a typical image forming apparatus (copying machine) in accordance with the present invention.

The structure and operation of the electrophotographic apparatus in FIG. 1 are as follows. An original 101 is placed on a glass platen 102 of a main assembly 100 of the electrophotographic apparatus (which hereinafter will be simply called "apparatus main assembly 100"), and an optical image of the original 101 is formed on an electrophotographic photosensitive member 104 (which hereinafter will be referred to as "photosensitive drum 104"), by a optical portion 103 comprising a plurality of mirrors M and a lens Ln. In each of a plurality of cassettes 105–108, a plurality of recording media (recording medium) P (which hereinafter will be referred to as "paper P") different in size are disposed one for one in layers. Among the plurality of cassettes 105–108, the cassette which contains the recording media which best match the data inputted by a user through a control panel 100*a* shown in FIG. 2, or the size of the original 101, is selected based on the paper size data of the cassettes 105–108. The recording medium selection does not need to be limited to paper; it is optional. For example, it may be an OHP sheet, or the like.

The papers P in the selected cassette are fed into the main assembly 100 while being separated from each other, by a corresponding feeding-separating apparatus (105A–108A), and are sequentially conveyed by a pair of registration rollers 110 by way of a recording medium conveying portion 109. The registration rollers 110 release the recording medium P in synchronism with the rotation of the photosensitive drum 104 and the scanning timing of the optical portion 103, allowing the recording medium P to be conveyed to a transfer station, in which the toner image on the photosensitive drum 104 is transferred onto the paper P by a transfer discharger (charging device) 111. Thereafter, the paper P, onto which the toner image has just been transferred, is separated from the photosensitive drum 104 by a separation charger (charging device) 112.

Thereafter, the paper P is conveyed to a fixing portion 114 by a paper conveying portion 113. In fixing portion 114, the toner image on the paper P is fixed to the paper P by heat and pressure. Then, when the copying apparatus is in a one-sided copy mode, a paper P is conveyed through the paper reversing portion 115, and is discharged into a delivery tray 117 by a pair of discharge rollers 116. When the copying apparatus is in a multilayer print mode, the paper P is moved-through paper re-feeding passages 119 and 120, by a flapper 118 of the paper reversing portion 115, and then, is conveyed to the pair of registration rollers 110, from which the paper P is conveyed through the same paper conveyance path as that through which the paper P is conveyed when the apparatus is in the one-sided print mode, and then, is discharged into the delivery tray 117.

Further, when the apparatus is in the two-sided print mode, the paper P is conveyed only halfway through the paper reversing portion 115. That is, as it is conveyed through the paper reversing portion 115, it is stopped at a point at which the paper P is partially extended outward from the apparatus by the pair of discharge rollers 116, more specifically, at a point at which the trailing edge of the paper P will have moved past the flapper 118, but, the paper P will remain nipped by the pair of discharge rollers 116. Then, the flapper 118 is switched in position, and the discharge rollers 116 are rotated in reverse, conveying thereby the paper P back into the apparatus main assembly 100. Thereafter, the paper P is conveyed to the registration rollers 110 through the paper re-feeding passages 119 and 120, and is discharged into the delivery tray 117 as it would be if the apparatus were in the one-sided print mode.

The main assembly 100 structured as described above also comprises a developing portion 201, cleaning portion 202, and primary charging device 203, which are disposed around the photosensitive drum 104. The developing portion 201 is for developing an electrostatic latent image formed on the peripheral surface of the photosensitive drum 104 by exposing the peripheral surface of the photosensitive drum 104 by the optical portion 103, in accordance with the image formation data obtained from the original 101. It uses toner as developer to develop the latent image. The main assembly 100 also comprises a toner supply container 1 for supplying the developing portion 201 with toner. The toner supply container 1 is removably mounted in the toner supply container compartment in the apparatus main assembly 100, by a user.

The developing portion 201 comprises a toner hopper 201*a* and a developing device 201*b*. The toner hopper 201*a* is provided with a stirring member 201*c* for stirring the toner supplied from the toner supply container 1.

After being stirred by the stirring member 201*c*, the toner is conveyed to the developing device 201*b*, by a magnetic roller 201*d*. The developing device 201*b* has a development roller 201*f* and a toner conveying member 201*e*. After being sent to the developing device 201*b* from the toner hopper 201*a* by the magnetic roller 201*d*, the toner is sent to the development roller 201*f*, by which it is supplied to the photosensitive drum 104.

The cleaning portion 202 is for removing the toner remaining on the photosensitive drum 104, and the primary charging device 203 is for charging the photosensitive drum 104.

Figure 2:
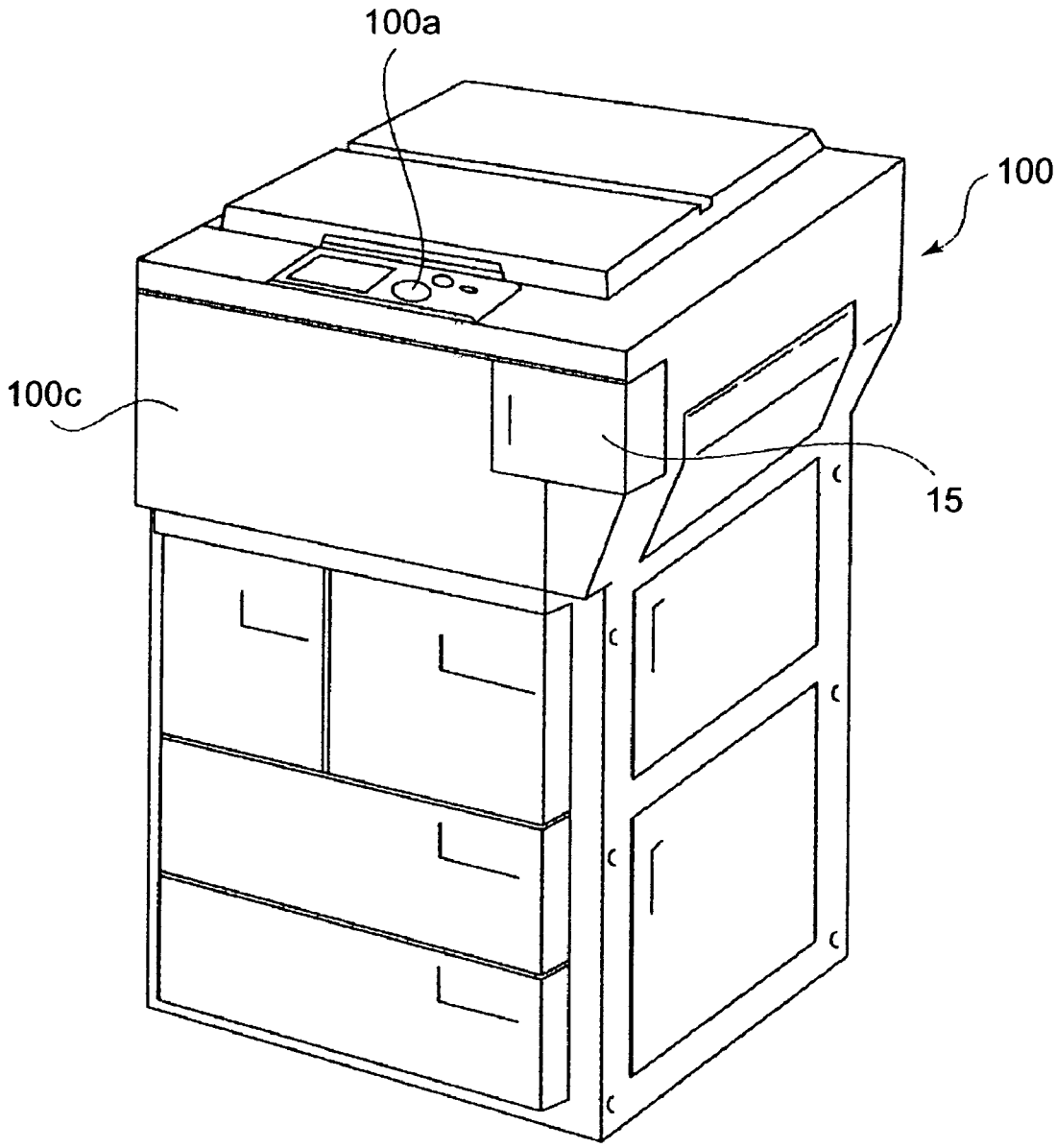
FIG. 2 is a perspective view of the electrophotographic copying machine shown in FIG. 1.
Figure 3:
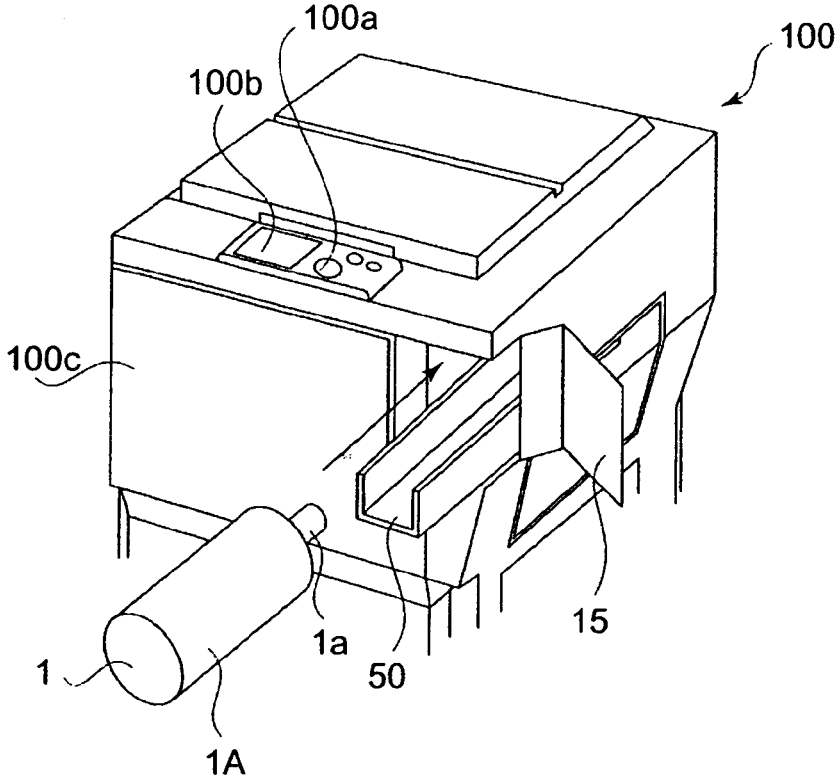
FIG. 3 is a perspective view of the top portion of the electrophotographic copying machine shown in FIG. 1, showing how a toner supply container is mounted into the main assembly of the machine after the opening of the toner container replacement cover of the machine.

Referring to FIG. 3, after opening a toner supply container replacement cover 15 (which hereinafter will be referred to as "replacement cover 15"), which is a part of the external shell of the copying machine shown in FIG. 2 a toner supply container tray 50 is pulled out to a predetermined point by a driving mechanism (unshown). The toner supply container 1 is placed in this container tray 50. If a user wants to remove the toner supply container 1 from the apparatus main assembly 100, the user is to remove the toner supply container 1 on the container tray 50 after pulling the container tray 50 out of the apparatus main assembly 100. The aforementioned replacement cover 15 is a dedicated cover for the replacement (mounting or dismounting) of the toner supply container 1; it is to be opened or closed only for the mounting or dismounting of the toner supply container 1. Incidentally, the maintenance for the apparatus main assembly 100 is to be carried out by opening a front cover 100*c*.

The provision of the container tray 50 is not mandatory. That is, the apparatus main assembly 100 may be structured so that the toner supply container 1 can be directly mounted into, or dismounted from, the apparatus main assembly 100.

Embodiment 1

Figure 4:
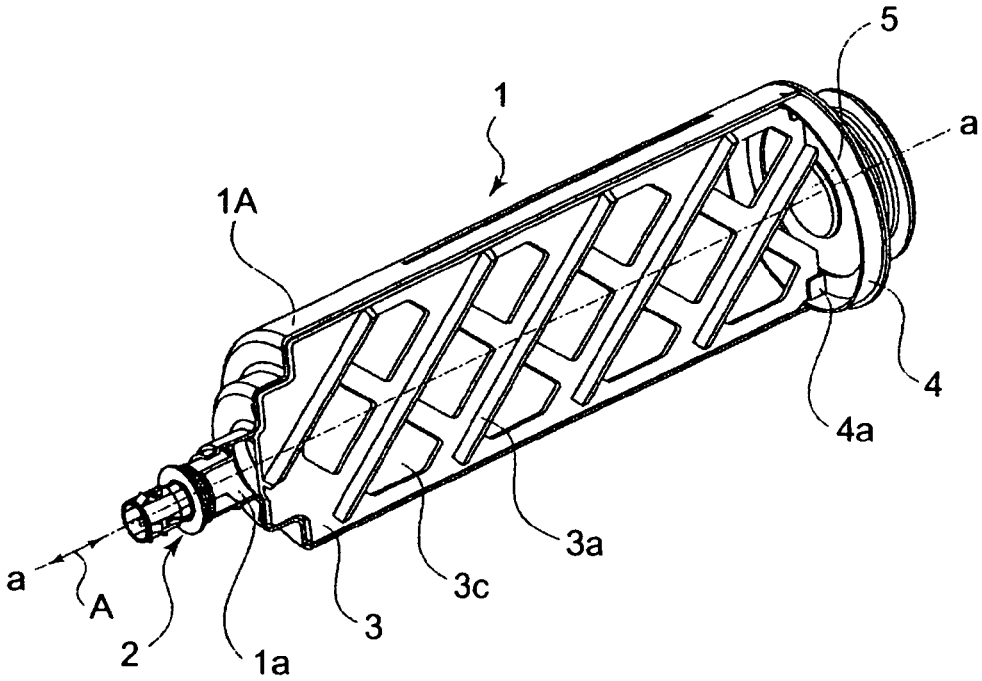
FIG. 4 is a perspective sectional view of the toner supply container in one of the preferred, embodiments of the present invention.
Figure 5:
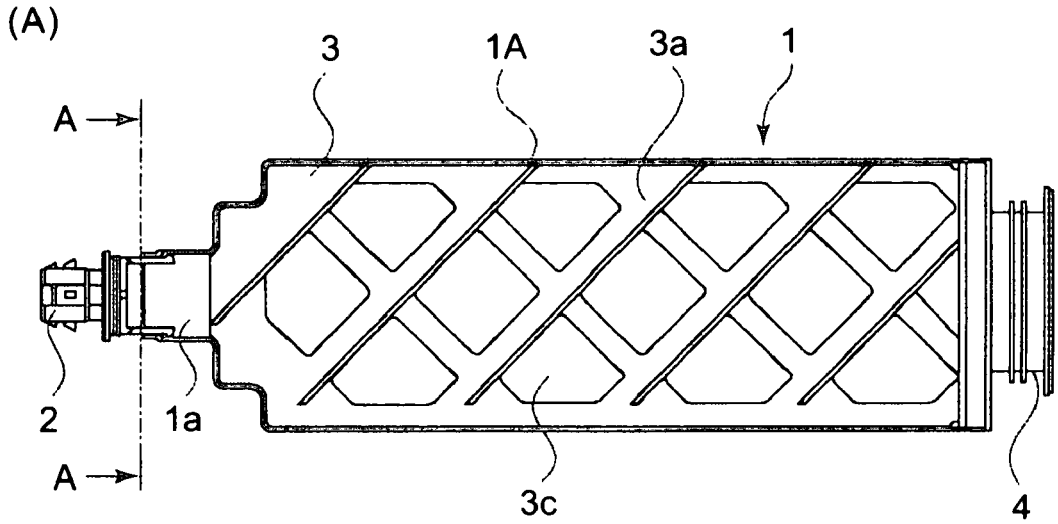
FIG. 5(A) is a sectional view of the toner supply container in the preferred embodiment, at a plane parallel to the axial line thereof.
FIG. 5(B) is a cross-sectional view of the same, at the line A—A in FIG. 5(A).
Figure 5:
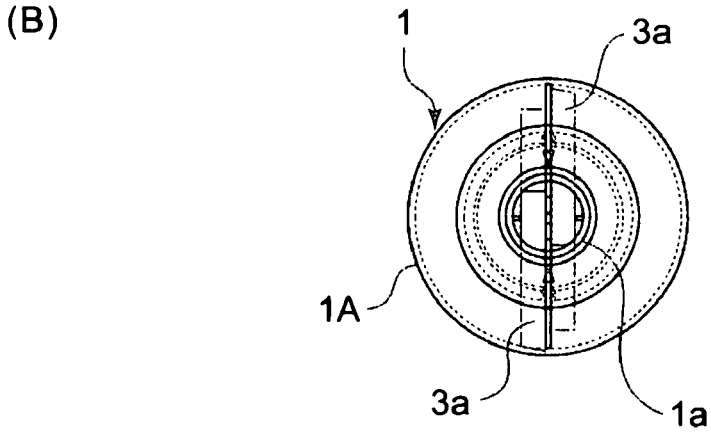

Next, referring to FIGS. 4, 5(A), and 5(B), the toner supply container 1 in the first embodiment of the present invention will be described. FIG. 4 is a perspective sectional view of the toner supply container 1 in the first embodiment of the present invention. FIG. 5(A) is a sectional view of the toner supply container 1, at the plane which coincides with the axial line of the toner supply container 1, and FIG. 5(B) is a cross-sectional view of the same, at a line A—A in FIG. 5(A).

(Toner Supply Container)

The toner supply container 1 and apparatus main assembly 100 are structured so that the toner supply container 1 is to be inserted into the apparatus main assembly 100 by a user, from a sealing member side of the toner supply container 1, in a direction parallel to the lengthwise direction of the toner supply container 1. In order to remove the toner supply container 1, the toner supply container 1 is to be pulled in the direction opposite to the direction in which the toner supply container 1 is inserted.

Referring to FIGS. 4, 5A, and 5(B), a toner bottle 1A (which hereinafter may be referred to simply as "bottle" or "container proper") is roughly cylindrical, and is hollow. It is provided with a cylindrical toner outlet 1*a*, which is smaller in diameter than the container proper 1A. The toner outlet 1*a* projects from the center portion of one of the end walls of the container proper 1A. The outward end of the toner outlet 1*a* is provided with an opening through which the toner in the container proper 1A is discharged into the image forming apparatus.

The opening of the toner outlet 1*a* is sealed with a sealing member 2, which is pressed into the toner outlet 1*a* through the opening thereof. More specifically, the sealing member 2 and container proper 1A are structured so that as the sealing member 2 is slid relative to the container proper 1A in the direction parallel to the axial line (direction indicated by arrow mark A in drawings), the opening of the toner outlet 1*a* is automatically sealed or unsealed. Incidentally, in FIG. 4, the opening of the toner outlet 1*a* is sealed.

First, the internal structure of the toner bottle 1A will be described.

The toner bottle 1A is roughly cylindrical. It is roughly horizontally placed in the apparatus main assembly 100 of an image forming apparatus. The toner supply container 1 and apparatus main assembly 100 are structured so that as the bottle 1A receives a rotational driving force from the apparatus main assembly 100, the bottle 1A rotates. Although in this embodiment, the rotational driving force is transmitted to the bottle 1A through ribs of the sealing member 2, the toner supply container 1 and apparatus main assembly 100 may be structured so that the rotational driving force is directly transmitted from the apparatus main assembly 100 to the bottle 1A. In other words, there is no specific restriction regarding the method for driving the bottle 1A.

Figure 9:
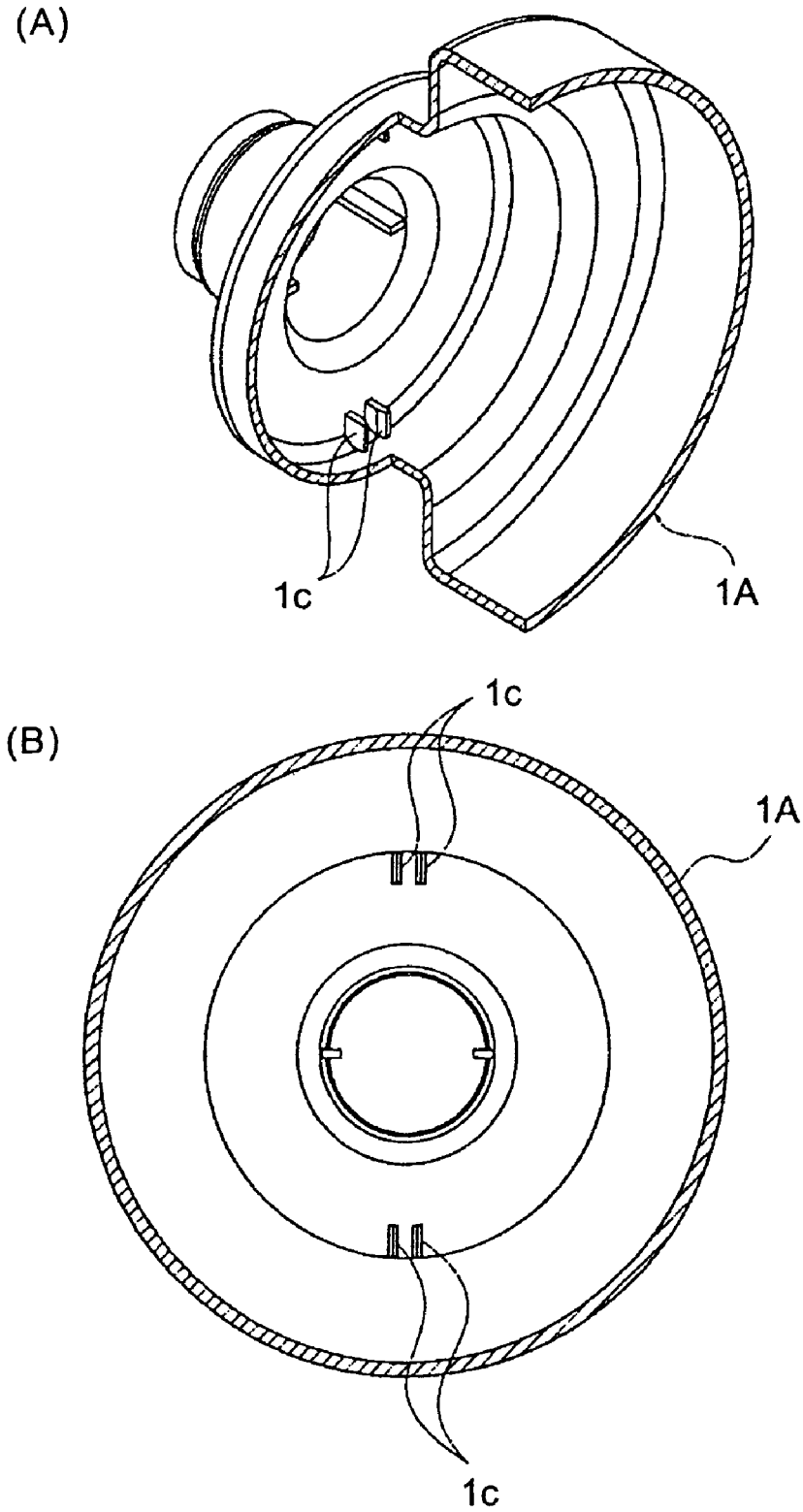
FIG.9 PRIOR ART
FIG. 9(A) is an internal perspective view of one of the essential portions of a typical toner supply container in accordance with the prior art.
FIG. 9(B) is a cross-sectional view of the same, at a plane perpendicular to the axial line of the container.

The bottle 1A is provided with a toner conveying member 3 comprising a flat portion and a plurality of slanted ribs. The toner conveying member 3 is placed in the toner bottle 1A in a manner to extend roughly from one lengthwise end of the bottle 1A to the other, dividing the internal space of the bottle 1A into two halves. The toner conveying member 3 is sandwiched by two pairs of ribs 1*c* (FIG. 9) on the internal surface of the toner bottle 1A, being virtually solidly fixed to the toner bottle 1A so that as the toner bottle 1A is rotated, the toner conveying member 3 rotates with the toner bottle 1A. Incidentally, the attachment of the toner conveying member 3 to the toner bottle 1A may be loose (there may be a small amount of play between the toner conveying member 3 and the ribs 1*c*) as long as it does not allow the toner conveying member 3 to separate from the toner bottle 1A. This method of fixing the toner conveying member 3 to the toner bottle 1A will be described later in detail.

Both of the surfaces of the flat portion of the toner conveying member 3 are provided with a plurality of ribs 3*a*, which are tilted relative to the rotational axis a—a of the toner bottle 1A so that as the bottle 1A is rotated in the predetermined direction, the toner therein will be conveyed toward the toner outlet 1*a*. More specifically, referring to FIG. 7(B), the plurality of ribs 3*a* are tilted so that as the toner in the bottle 1A slides down on the ribs 3*a*, it is guided toward the toner outlet 1*a*. In other words, the flat portion of the toner conveying member 3 is the portion for supporting the ribs 3*a*.

The rib 3*a* closest to the inward opening of the toner outlet 1*a* is positioned so that its end on the toner outlet side is placed virtually in the inward opening of the cylindrical toner outlet 1*a*. Thus, as the toner bottle 1A is rotated, the toner is conveyed toward the toner outlet 1*a* by the plurality of diagonal ribs 3*a*, and eventually slides down on this rib 3*a* closest to the toner outlet 1*a*, into the inward opening thereof, and then, is discharged from the toner bottle 1A through the toner outlet 1*a*. The rib 3*a* closest to the toner outlet 1*a* may be placed so that its end on the toner outlet side is positioned in the immediate adjacencies of the inward opening of the toner outlet 1*a*.

Referring to FIG. 5(B), the two sets of slanted ribs 3*a* are placed on the two surfaces of the flat portion of the toner conveying member 3, one for one, so that the two sets of ribs 3*a* are symmetrical to each other with reference to the rotational axis of the toner bottle 1A. All ribs 3*a* are tilted in the direction to convey the toner in the bottle 1A toward the inward opening of the toner outlet 1*a* as the bottle 1A is rotated in a predetermined direction. More specifically, they are attached to the flat portion of the toner conveying member 3 in such a manner that as the toner conveying member 3 is rotated 180° along with the bottle 1A, the toner scooped up by one set of the ribs 3*a* during the preceding 180° rotation slides down the same sets of the ribs 3*a*, and then, is scooped up by the other set of the ribs 3*a* during the following 180° rotation, and so on. In other words, the toner in the bottle 1A is efficiently conveyed and discharged as the bottle 1A is rotated; as the toner conveying member 3 is rotated once along with the toner bottle 1A, the toner in the bottle 1A is incrementally conveyed twice toward the toner outlet 1*a*. Thus, the toner in the toner bottle 1A can be virtually continuously conveyed toward the toner outlet 1*a*, and be discharged from the bottle 1A through the toner outlet 1*a*, by continuously rotating the bottle 1A at a high speed. Incidentally, when the two sets of the ribs 3*a* of the toner conveying member 3 are positioned on the two surfaces of the flat portion of the toner conveying member 3, one for one, so that as the toner conveying member 3 is rotated 180°, the set of ribs 3*a* on one of the two surfaces of the flat portion takes virtually the exact position which the set of ribs 3*a* on the other surface of the flat portion had before the 180° rotation of the toner conveying member 3, the two sets of the ribs 3*a* are said to be rotationally symmetrical with reference to the rotational axis of the toner conveying member 3.

Figure 6:
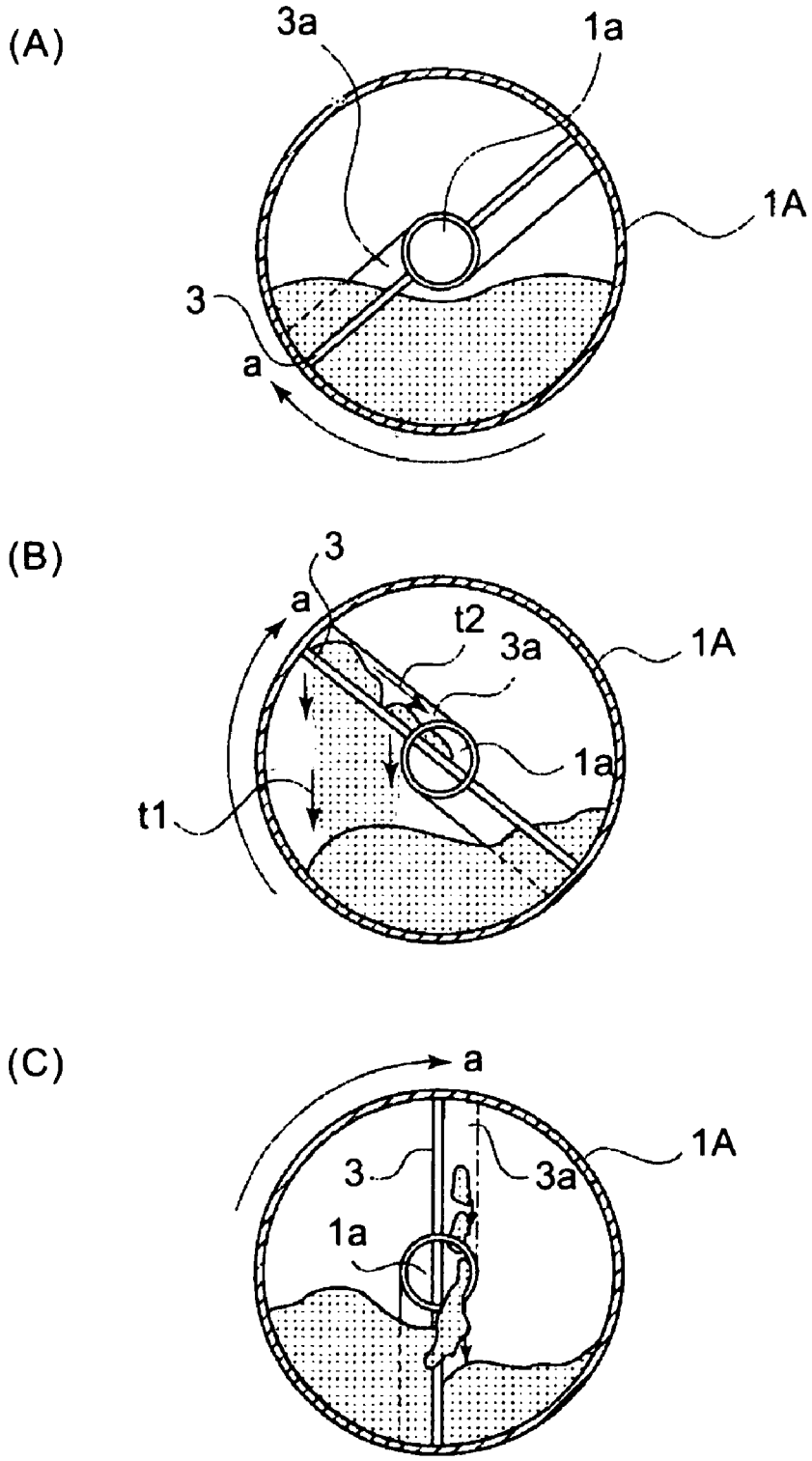
FIGS. 6(A), 6(B), and 6(C) are schematic cross-sectional views of the toner supply container taken at line A—A in FIG. 5(A), illustrating the principle involved in the toner discharge from the toner supply container in accordance with the present invention.

Next, referring to FIGS. 6(A)–6(C) and 7(A)–7(C), the principle of the toner discharge from the toner supply container 1 will be described. FIGS. 6(A)–6(C) cross-sectional views of the toner supply container 1, at the line A—A in FIG. 5(*a*).

Figure 7:
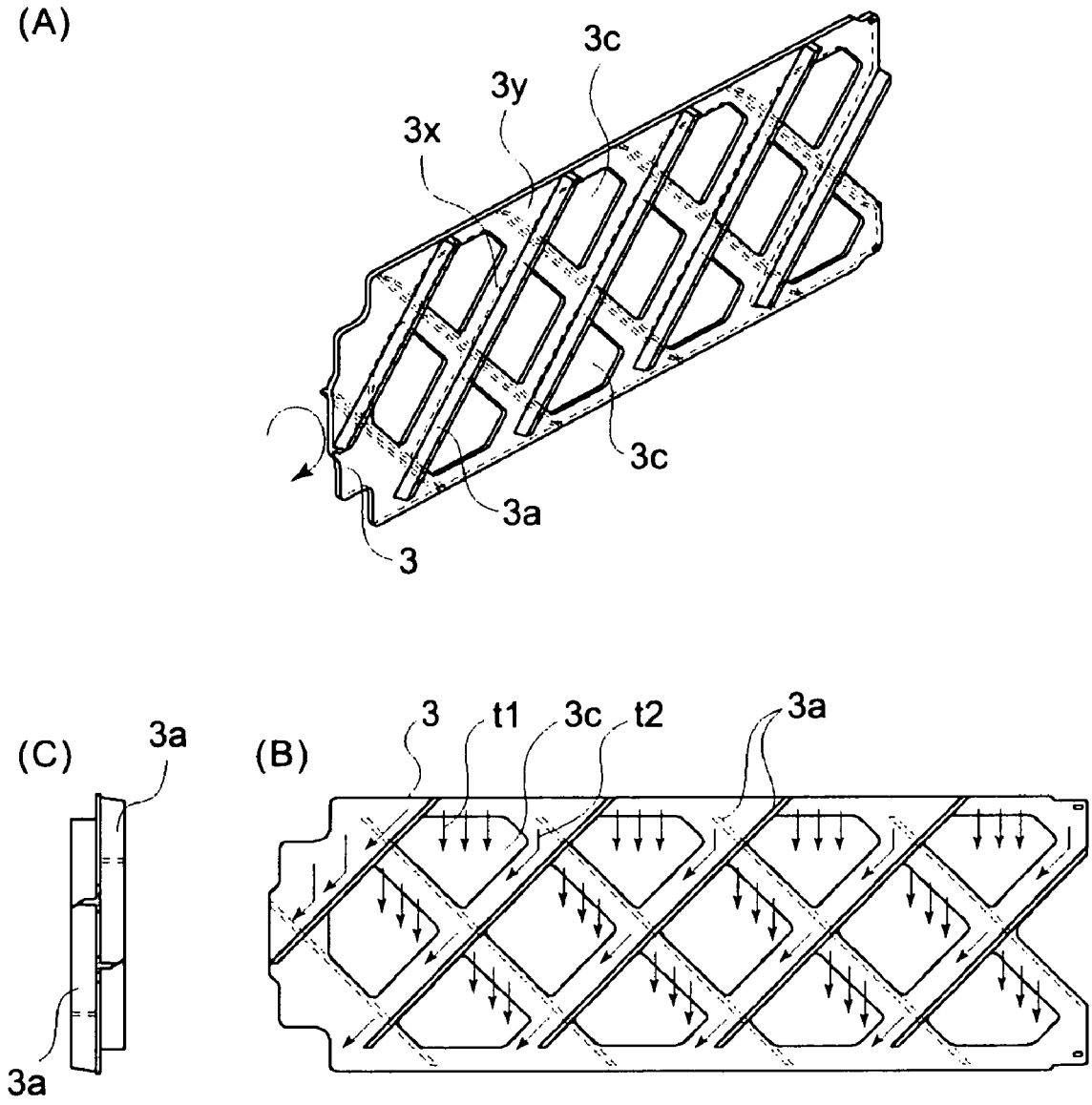
FIG. 7(A) is a perspective view of the developer conveying member.
FIG. 7(B), a plan view thereof.
FIG. 7(C) is a left side view thereof.

Referring to FIG. 6(A), as the toner bottle 1A rotates along with the toner conveying member 3 in the direction indicated by an arrow mark a, the toner in the toner bottle 1A is gradually lifted against gravity by the lifting portion, that is, the flat portion of the toner conveying member 3, (portion of flat plate, which is capable of reaching into the body of toner having settled at the bottom of the toner bottle 1A due to gravity, and which does not have through holes; it is equivalent to the area 3*y* in FIG. 7(A)).

More specifically, in this embodiment, the toner is lifted by being scooped into the nook formed by the top end portion of each slanted rib 3*a* (end portion of slanted rib 3*a*, which will be on the top side when the slanted rib 3*a* is oriented in the direction to guide the toner toward the toner outlet 1*a* by allowing the toner to slide down thereon (for example, as in FIG. 7(B)), the aforementioned toner lifting portion (portion equivalent to area 3*y* in FIG. 7(A)) of the flat plate, and the internal surface of the toner bottle 1A.

The toner conveying member 3 is positioned so that its flat portion is placed virtually in contact with the internal surface of the toner bottle 1A, across roughly the entire lengthwise range of the toner bottle 1A, as described above. Therefore, the internal surface of the toner bottle 1A is utilized to efficiently lift the toner.

Further, as the toner in the toner bottle 1A encounters the toner conveying member 3 as it slides down on the internal surface of the toner bottle 1A due to the rotation of the toner bottle 1A, some of it is lifted up by the toner lifting portion of the toner conveying member 3, while the rest of it moves past the toner conveying member 3 through holes 3*c* of the flat portion of the toner conveying member 3, being thereby stirred. In other words, as the toner bottle 1A is rotated, not only is the toner in the toner bottle 1A lifted by the toner conveying member 3, but also, it is stirred by the toner conveying member 3.

As the rotation of the toner bottle 1A progresses to the stage shown in FIG. 6(B), a portion of the toner having been scooped up by the toner conveying member 3 begins to slide down, due to gravity, on the slanted ribs 3*a* and the portion 3*x* of the flat plate, which is supporting the slanted ribs 3*a*. As a result, this portion of the toner (portion $t_2$ of toner in FIG. 6(B), FIG. 7(B)) is guided toward the toner outlet 1*a*.

The rest of the scooped toner, that is, the portion of the scooped toner (portion $t_1$ in FIG. 6(B) and FIG. 7(B)), which does not slide down on the toner conveying member 3, falls through the through holes 3*c* of the flat potion, into the reverse side of the toner conveying member 3. In other words, as the toner bottle 1A is rotated, not only is a portion of the toner in the toner bottle 1A scooped up by the toner conveying member 3 and guided toward the toner outlet 1*a*, but also, the rest of the toner scooped up by the toner conveying member 3 falls through the through holes 3*c* of the toner conveying member 3. Therefore, as the toner bottle 1A is rotated, the toner in the toner bottle 1A is satisfactorily stirred while being conveyed toward the toner outlet 1*a*.

As the toner bottle 1A is continuously rotated, the above described process is repeated. Therefore, the toner in the toner bottle 1A is virtually continuously conveyed toward the toner outlet 1*a* while being sufficiently stirred. Eventually, the toner is moved into the toner outlet 1*a* by the slanted rib 3*a* closest to the toner outlet 1*a*, and is discharged from the toner bottle 1A through the toner outlet 1*a*, as shown in FIG. 6(C).

As described above, in this embodiment, the toner supply container 1 is provided with the toner conveying member 3 comprising the flat portion which extends in the lengthwise direction of the toner bottle 1A across virtually the entire range of the toner bottle 1A, and the plurality of slanted ribs 3*a* attached to the flat portion. Therefore, the toner in the toner supply container 1 is efficiently conveyed while being sufficiently stirred.

(Toner Conveying Member)

Next, the toner conveying member 3 in accordance with the present invention will be described. The toner conveying member 3 is placed in the container proper 1A so that it extends in the direction parallel to the axial line of the container proper 1A in a manner to divide the internal space of the container proper 1A into a plurality of sub-spaces. In this embodiment, the toner supply container 1 is provided with the toner conveying member 3 that divides the internal space of the container proper 1A into two halves. However, the toner conveying member 3 may be configured so that it extends in the lengthwise direction of the container proper 1A in a manner to divide the internal space of the container proper 1A into three or more sub-spaces of the same size.

The toner conveying member 3 is desired to be positioned so that its rotational axis coincides with the axial line of the toner outlet 1*a*, or the theoretical extension thereof, for the following reason. That is, the toner must be eventually discharged from the toner bottle 1A through the toner outlet 1*a*, by the ribs 3*a* of the toner conveying member 3, as described above. Therefore, the edge of the toner conveying member 3 next to the inward opening of the toner outlet 1*a* is desired to be positioned in a manner to divide the inward opening of the toner outlet 1*a* into two halves. This is why the toner conveying member 3 is desired to be positioned so that its rotational axis coincides with the axial line of the toner outlet 1*a*, or the theoretical extension thereof.

The toner supply container 1 is structured so that the toner conveying member 3 rotates with the container proper 1A, and also, so that it extends in the lengthwise direction of the container proper 1A across virtually the entire lengthwise range of the container proper 1A. Therefore, not only does the toner conveying member 3 convey the toner while stirring it, but also, it functions as a reinforcement rib for the container proper 1A.

Further, the toner conveying member 3 rotates with container proper 1A with the presence of no difference in rotational speed between the two. Therefore, such a problem that the toner is solidified by the friction between the toner conveying member 3 and container proper 1A does not occur.

Therefore, the container proper 1A of the toner supply container 1, which is in the form of a long and narrow cylinder, is reinforced by the toner conveying member 3 (which functions as if it is an internal frame of the container proper 1A). In other words, providing the toner supply container 1 with the toner conveying member 3 in accordance with the present invention makes it possible to reduce the thickness of the wall of the container proper 1A, not only to reduce the cost of the container proper 1A, but also, to increase the range of possible selections for the substances usable as the material for the container proper 1A.

Next, referring to FIGS. 7(A)–7(C), the toner stirring effect of the toner conveying member 3 will be described.

FIG. 7(A) is a perspective view of the toner conveying member 3 in the first embodiment of the present invention, and FIG. 7(B) is a plan view of the same, as seen from the direction perpendicular to the axial line of the toner bottle 1A. FIG. 7(C) is a view of the toner conveying member 3 shown in FIG. 7(B), as seen from the left side of FIG. 7(B).

The toner conveying member 3 in FIGS. 7(A)–7(C) comprises the flat portion having the plurality of through holes 3*c*, which allow the toner in the toner bottle 1A to freely move between the adjacent two sub-spaces, into which the internal space of the toner bottle 1A is divided by the toner conveying member 3.

More specifically, as the toner bottle 1A is rotated, a certain amount of the toner in the toner bottle 1A is lifted by the toner conveying member 3. Then, as the toner bottle 1A is further rotated, some of the lifted toner is guided, being thereby conveyed toward the toner outlet 1*a*, by the slanted ribs 3*a*, whereas the rest of the lifted toner falls through the through holes 3*c*. In other words, the provision of the through holes 3*c* is effective to make the toner in the toner bottle 1A move in various directions.

As the toner falls through the holes 3*c*, the portions of the toner having agglomerated easily loosen because of the impact from the fall, greatly improving thereby the fluidity of the toner in the toner bottle 1A. Since the plurality of through holes 3*c* are evenly distributed from one lengthwise end of the toner bottle 1A to the other, the fluidity of the toner is very quickly improved across the entire range of the toner bottle 1A, making it possible for the toner in the toner bottle 1A to be satisfactorily discharged from the toner bottle 1A virtually immediately after the replacement of the toner supply container 1. In other words, the time required to keep the toner supply container 1 in accordance with the prior art rotating until the toner discharge from the toner supply container 1 stabilizes becomes unnecessary, substantially reducing thereby the downtime (period in which image formation is impossible) of an image forming apparatus.

Although the above described toner conveying member 3 is desired to be injection molded of resinous substance such as plastic, it may be formed of a substance other than a resinous substance, with the use of a manufacturing method other than injection molding. In principle, the material for the toner conveying member 3 is desired to be the same as that for the toner bottle 1A, in consideration of the recycling of the toner supply container 1. More specifically, such substances as ABS, PP, POM and HI-PS, are preferable. In this embodiment, and HI-PS is used.

(Assembly Method for Toner Supply Container)

Next, the method for assembling the toner supply container 1, which best characterizes the present invention, will be described.

Figure 8:
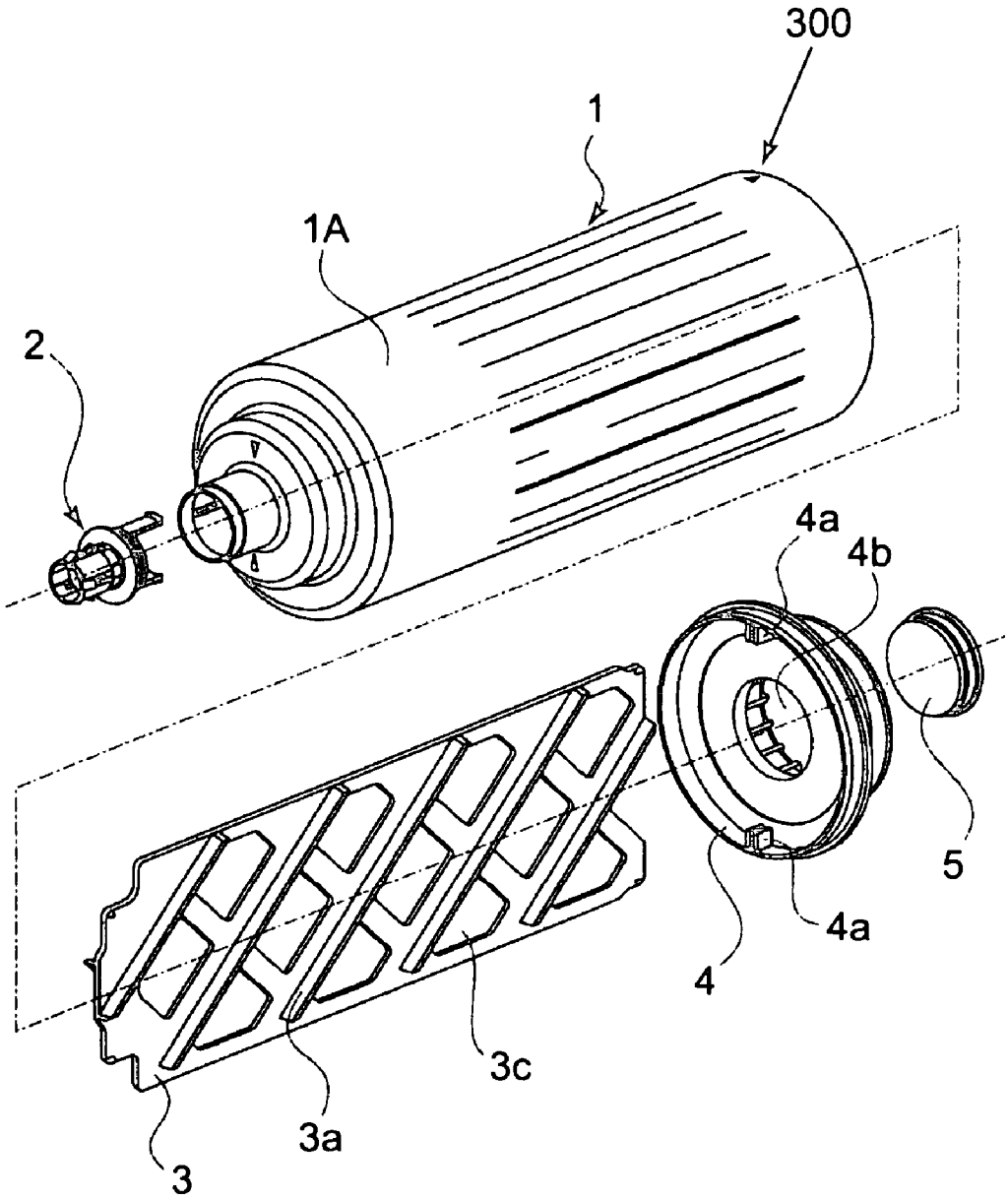
FIG. 8 is a perspective view of the toner supply container in accordance with the present invention, showing the assembly process thereof.

FIG. 8 is a perspective view of the toner supply container 1 in the first embodiment of the present invention, showing how the toner supply container 1 is assembled. The toner supply container 1 in the first embodiment is very simple in structure. That is, it can be completed by putting together only five components as shown in FIG. 8.

The container proper 1A is easily formed of resin by injection molding or blow molding, and the sealing member 2, toner conveying member 3, flange 4 as a capping member, and plug 5 for sealing the opening of the capping member (flange 4), are easily formed by injection molding. In this embodiment, all of the above listed components are formed by injection molding.

Figure 12:
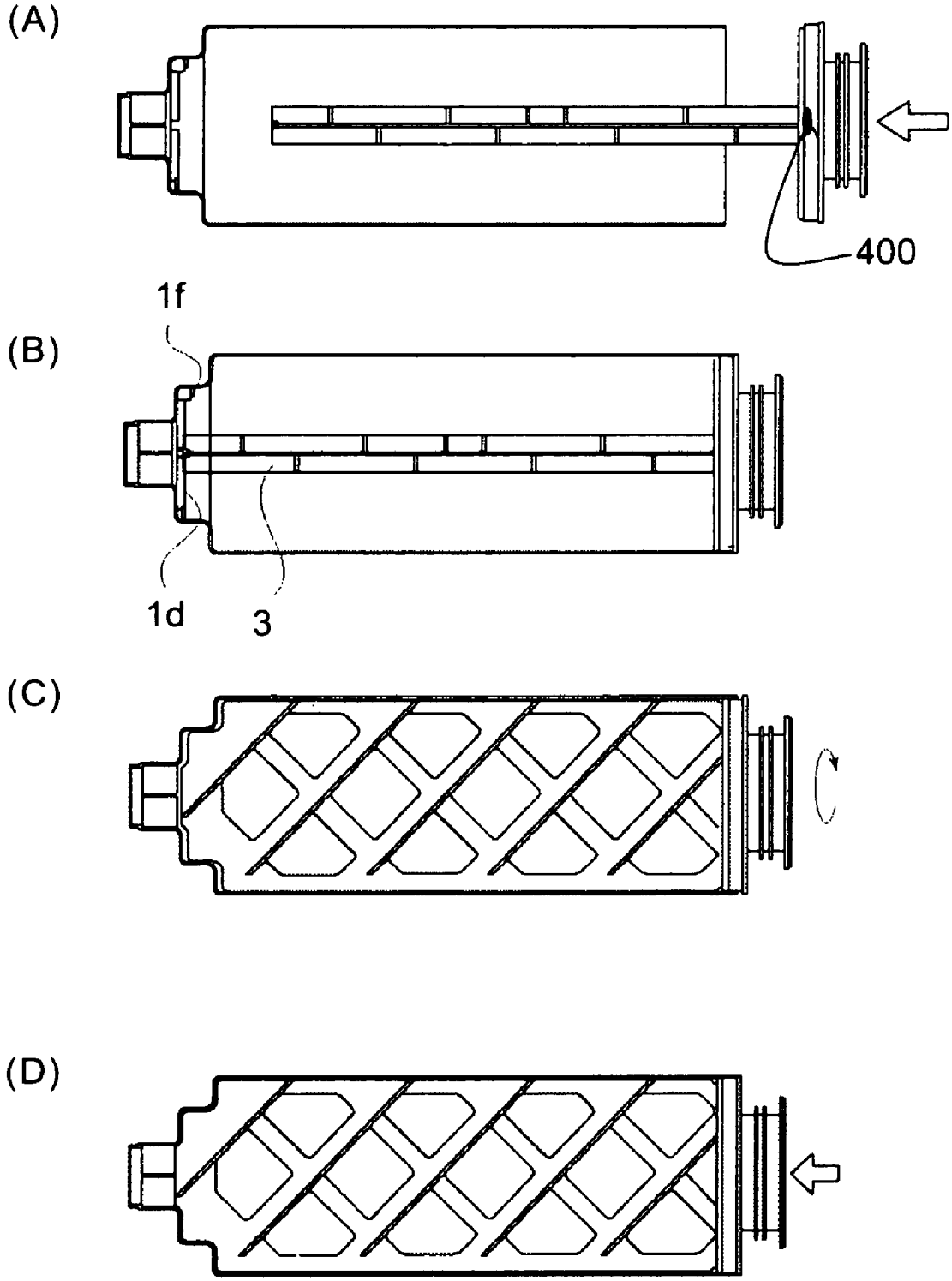
FIGS. 12(A)–12(D) are schematic drawings showing the assembly sequence for the toner supply container in accordance with the present invention.

The ribs 1*c* for holding the toner conveying member 3, which will be described later, are injection molded as integral parts of the container proper 1A. Referring to FIG. 12(A), the direction in which metallic molds are extracted when molding the container proper 1A having the ribs 1*c*, is opposite to the direction (in which toner conveying member 3 is inserted) indicated by an arrow mark in the drawing. Thus, the ribs 1*c* are extended roughly parallel to the direction in which the toner conveying member 3 is inserted into the container proper 1A.

As for the method for attaching the flange 4 to the container proper 1A, the flange 4 may be welded to the container proper 1A by ultrasonic welding, vibration welding, or the like, or may be glued to the container proper 1A with the use of one of various adhesives, for example, hot-melt glue, because these methods are very simple, and yet, are reliable in sealing.

Further, the flange 4 and container proper 1A may be designed so that the portion of the flange 4 on the container proper side can be fitted into the container proper 1A with the application of a slight pressure, and also, so that the joint between the two components can be wrapped by adhesive tape or the like to assure that the two components remain adhered to each other. Such an arrangement makes it much easier to disassemble in order to recycle the toner supply container 1.

As for the assembly sequence, first, the trailing end of the toner conveying member 3 in terms of the direction in which the toner conveying member 3 is fitted between a pair of ribs 4*a*, as rib holding portions, is positioned on the internal surface of the flange 4. Then, the toner conveying member 3 is inserted into the container proper 1A so that the other end of the toner conveying member 3 will be sandwiched by the pair of ribs 1*c*, as rib holding portions, on the opposite lengthwise end of the internal surface of the container proper 1A from the lengthwise end from which the toner conveying member 3 is inserted.

By designing the container proper 1A and toner conveying member 3 so that the toner conveying member 3 can be inserted into the container proper 1A as described above, the toner conveying member 3 can be firmly held to the container proper 1A so that the toner conveying member 3 will rotate with the container proper 1A.

The most difficult step in this process of fixing the toner conveying member 3 to the interior of the toner bottle 1A by inserting the toner conveying member 3 into the toner bottle 1A is how to correctly insert the toner conveying member 3 between the pair of ribs 1*c*.

The method for correctly inserting the toner conveying member 3 between the ribs 1*c* of the toner bottle 1A will be described with reference to a toner supply container (1) in accordance with the prior art shown in FIGS. 9(A) and 9(B).

In the case of a toner supply container (1) in accordance with the prior art, in order to fix the toner conveying member (3) to the container proper (1A), the toner conveying member (3) is placed in the container proper (1A) so that the toner conveying member (3) is sandwiched by the two pairs of ribs (1*c*), that is, the pair of ribs (1*c*) on the adjacencies of the deepest end of the internal surface of the container proper (1A) in terms of the toner conveying member insertion direction, and the pair of ribs (4*a*) of the flange (4). The fitting the trailing end of the toner conveying member (3) between the ribs (4*a*) of the flange (4) creates little problem, because the toner conveying member (3) is inserted into the container proper (1A) after the toner conveying member (3) is fitted between the ribs (4*a*) of the flange (4). However, correctly fitting the leading end of the toner conveying member (3) between the pair of ribs (1*c*) at the deepest end of the container proper (1A) is very difficult for the following reason. That is, in order to properly fit the leading end of the toner conveying member (3) into the narrow gap between the pair of ribs (1*c*) located near the deepest end of the container proper (1A), it is necessary to confirm whether or not the leading end of the toner conveying member (3) is accurately aimed at the narrow gap between the ribs (1*c*) while the toner conveying member (3) is inserted. This confirmation is very difficult, because while the toner conveying member (3) is inserted into the container proper (1A), it is virtually impossible to see the leading end of the toner conveying member (3). This problem is exacerbated in the case of a long and narrow toner supply container. Therefore, in the case of the toner supply container (1) in accordance with the prior art, assembly errors are possible; for example, the flange (4) is sometime welded without fixing the toner conveying member (3) to the proper position of the container proper (1A), allowing the toner conveying member (3) to remain unstable in the container proper (1A). In order to prevent such assembly errors, that is, in order to assure that the toner conveying member (3) is inserted into the proper position, it is necessary to prepare a dedicated assembly jig, which makes a cost increase inevitable.

The above described assembly problem involving the toner supply container (1) in accordance with the prior art can be solved by designing a toner supply container, in accordance with the present invention, as will be described next.

Figure 10:
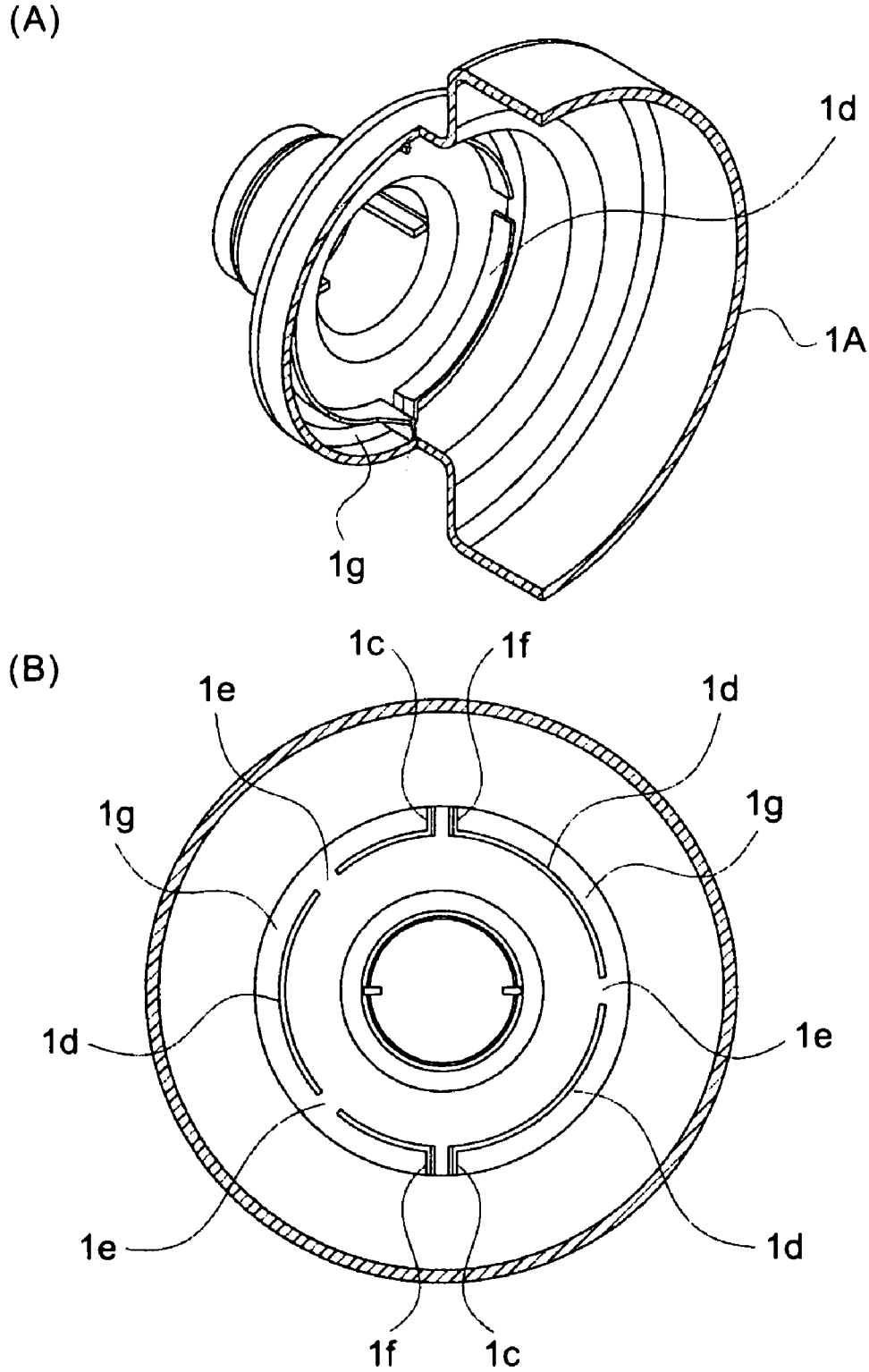
FIG. 10(A) is an internal perspective view of one of the essential portions of the toner supply container in accordance with the present invention.
FIG. 10(B) is a cross-sectional view of the same, at a plane perpendicular to the axial line of the container.
Figure 11:
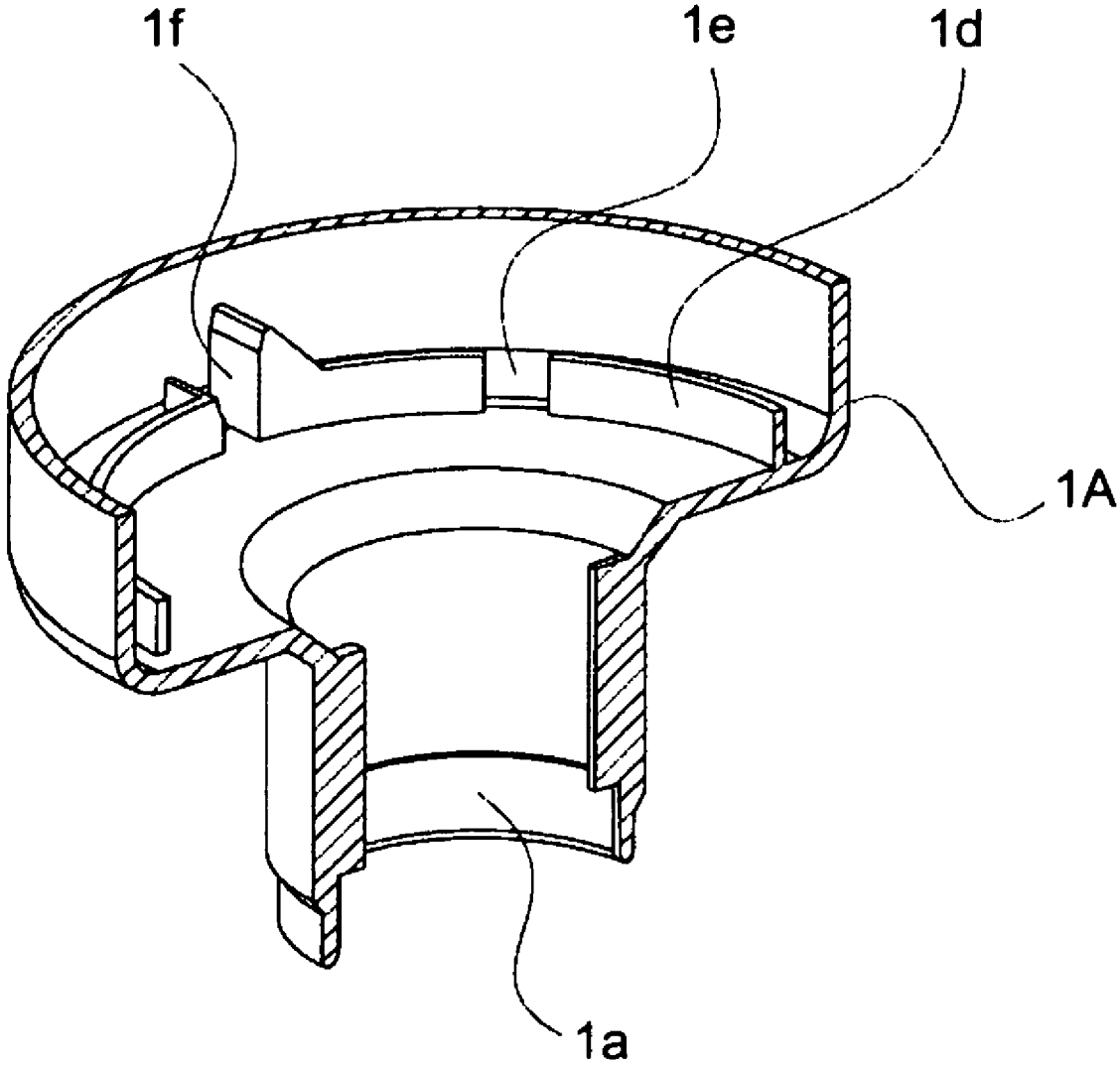
FIG. 11 is an internal perspective view of one of the essential portions of the toner supply container in accordance with the present invention.

Next, referring to FIGS. 10(A) and 10(B), the solution to the above described problem will be described. FIG. 10(A) is a sectional perspective view of the container proper 1A in the first embodiment of the present invention, and FIG. 10(B) is a cross sectional view of the same. The above described problem can be solved by providing the container proper 1A with a plurality of arcuate ribs id (toner conveying member guiding ribs) for guiding the leading end of the toner conveying member 3 to the gaps between the pair of ribs 1*c*, as shown in FIG. 10(B). The centers of curvature of these arcuate ribs 1*d* coincide. The arcuate ribs 1*d* extend from the ribs 1*c*, with the provision of a few intervals 1*e*. With the provision of the above described arcuate ribs 1*d*, if the toner conveying member 3 is inserted into a position other than the predetermined position, the leading end of the toner conveying member 3 comes into contact with the arcuate ribs 1*d*, preventing the toner conveying member 3 from being completely inserted into the container proper 1A unless the toner conveying member 3 is properly inserted; in other words, the trailing end portion of the toner conveying member 3 will remain sticking out of the container proper 1A by a length equal to the height of the ribs 1*c*, making it easier to visually recognize that the toner conveying member 3 is not in the correct position in the container proper 1A.

When it is recognized that the toner conveying member 3 is not in the correct position in the container proper 1A, the toner conveying member 3 is to be rotated in the rightward direction. As the toner conveying member 3 is rotated in the rightward direction, the toner conveying member 3 is stopped by a stopper portion 1*f* of the arcuate rib 1*d*, which is equivalent to one of the pair of ribs 1*c*, and fits into the gap between the pair of ribs 1*c*, that is, the gap between the stopper portion 1*f* and the other rib 1*c*.

Without the stopper portion 1*f*, the probability that the toner conveying member 3 will be rotated past the predetermined position is fairly high. In other words, the stopper portion if is very effective to prevent the toner conveying member 3 from being rotated past the predetermined position. Further, in order to assure that the toner conveying member 3 is properly positioned whether the toner conveying member 3 is rotated in the rightward or leftward direction, the container proper 1A is provided with two stopper portions if, which are symmetrically positioned with reference to the rotational axis of the toner conveying member 3 (rotational axis of container proper 1A).

The reason that a few intervals are provided among the arcuate ribs 1*d* is as follows. That is, without the intervals among the arcuate ribs 1*d*,that is, if the container proper 1A is provided with only two arcuate ribs 1*d*, which connect the two pairs of ribs 1*c*, some developer may permanently remain in a space 1*g* between the arcuate ribs 1*c* and internal surface of the container proper 1A. Therefore, the container proper 1A is provided with three or more arcuate ribs 1*d* separated by the intervals 1*e*, in order to prevent the arcuate ribs 1*c* from making it impossible for the developer in the space 1*g* to be discharged from the toner supply container 1. More specifically, with the provision of these intervals 1*e*, as the toner bottle 1A is rotated, the developer in the space 1*g* moves to the toner conveying member 3 through the intervals 1*e*. Therefore, virtually the entirety of the developer in the toner supply container 1 can be discharged from the toner supply container 1. From the standpoint of developer discharge, the number of the intervals 1*e* is desired to be as large as possible. However, the number of the intervals 1*e* affects the aforementioned accuracy with which the toner conveying member 3 is fixed to the container proper 1A. Therefore, serious consideration must be made when determining the number and locations of the intervals 1*e*. In the case of this embodiment, three intervals 1 e are provided, as shown in FIG. 10(B), and they are positioned so that even if the toner conveying member 3 aligns with one of the intervals 1*e*, the toner conveying member 3 is prevented from being fully inserted into the container proper 1A.

As described above, according to the present invention, even if a toner supply container is structured like a toner supply container in accordance with the prior art so that the leading end of the toner conveying member, in terms of the toner conveying member insertion direction, is difficult to fix to the proper position P in the deepest end portion in the container proper of the toner supply container, the leading end of the toner conveying member can automatically be placed into the predetermined position in the deepest end portion of the container proper of the toner supply container, by simply rotating the toner conveying member 3 in either rightward or leftward direction after incorrectly inserting the toner conveying member into the container proper. Therefore, not only can a toner supply container be very easily and very reliably assembled, but also, the jigs necessary for assembling a toner supply container in accordance with the prior art become unnecessary, resulting in a cost reduction.

Next, referring to FIGS. 12(A)–12(D), the assembly sequence for the toner supply container 1 in accordance with the present invention will be described.

First, the toner conveying member 3 is loosely fixed to the flange 4. Then, the toner conveying member 3 loosely fixed to the flange 4 is inserted into the container proper 1A, disregarding the attitude of the toner conveying member 3 in terms of the circumferential direction of the container proper 1A (FIG. 12(A)). During this insertion of the toner conveying member 3, the mark 300 (FIG. 8) on the peripheral surface of the toner bottle 1A is to be roughly aligned with the mark 400 (FIG. 12(A)) on the flange 4. These marks are for roughly aligning the pair of ribs 1*c* in the adjacencies of the deepest end of the container proper 1A, with the pair of ribs 4*a* on the flange 4, and are positioned to assure that as the toner conveying member 3 is inserted into the container proper 1A, the toner conveying member 3 comes into contact with one or more of the arcuate ribs 1*d*. Further, the number and positioning of the intervals 1*e* are determined so that the toner conveying member 3 is prevented from being inserted into the intervals 1*e* of the arcuate ribs 1*d* when the toner conveying member 3 is inserted into the container proper 1A.

Toward the end of the insertion of the toner conveying member 3 into the container proper 1A, the leading end of the toner conveying member 3, in terms of the toner conveying member insertion direction, comes into contact with the arcuate ribs 1*d*.

At this point, the toner conveying member 3 is to be rotated in the rightward direction while being kept in contact with the arcuate ribs 1*d* as shown in FIG. 12(B), until the toner conveying member 3 comes into contact with the stopper portion 1*f* (FIG. 12(C)).

As the toner conveying member 3 comes into contact with the stopper portion 1*f*, the toner conveying member 3 is to be inserted further into the container proper 1A in the axial direction of the container proper 1A until the toner conveying member 3 is inserted into the predetermined position, in other words, until the toner conveying member 3 is inserted into each of the gaps between the two pairs of ribs 1*c*. As the toner conveying member 3 is inserted between each of the gaps between the two pairs of ribs 1*c*, it is properly positioned relative to the container proper 1A, while being virtually solidly fixed to the container proper 1A (FIG. 12(D)).

As described above, according to the present invention, the toner conveying member 3 can be easily inserted into the container proper 1A of the toner supply container 1 while assuring that the toner conveying member 3 is properly positioned relative to the container proper 1A, and also, that the toner conveying member 3 is virtually solidly fixed to the container proper 1A.

After the proper insertion of the toner conveying member 3 into the container proper 1A, the flange 4 is ultrasonically welded to the container proper 1A. Thereafter, toner is poured into the container proper 1A through a toner inlet 4*b*, and then, the plug 5 is pressed into the toner inlet 4*b* (FIG. 8), ending the assembly of the toner supply container 1.

As described above, according to the present invention, it takes a very short time to reliably place the toner conveying member in the predetermined position in the container proper of a toner supply container. Further, a toner supply container is simple in structure, being therefore easier to assemble. Therefore, it is possible to prevent the problem that a toner supply container is erroneously assembled. Therefore, it is possible to improve a toner supply container in assembly efficiency and yield.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container detachably mountable to an image forming apparatus, said developer supply container comprising:

a container body configured to contain a developer;

a discharge opening configured and positioned to permit discharge of the developer from an inside of said container body;

a plate-like member having a feeding portion configured and positioned to feed the developer in said container body toward said discharge opening with rotation of said container body;

a pair of engaging portions, provided on an inner surface at one longitudinal end of said container body, configured and positioned to engage between said engaging portions said plate-like member inserted from the other longitudinal end of said container body; and a guide portion configured and positioned to guide said plate-like member toward a position between said engaging portions.

2. A developer supply container according to claim 1, wherein said guide portion includes:

a rotation guide portion which is capable of being abutted by a leading end portion of said plate-like member with respect to an inserting direction and which is effective to guide rotation of said plate-like member toward between said engaging portions; and a stopper portion configured and positioned to stop rotation of said plate-like member between said engaging portions.

3. A developer supply container according to claim 2, wherein said rotation guide portion extends from one of said engaging portions in a circumferential direction, and wherein said stopper portion extends from the other one of said engaging portions in a direction crossing the circumferential direction.

4. A developer supply container according to claim 2 or 3, wherein said rotation guide portion has a recess configured and positioned to direct the developer from between an inner wall of said container body and itself toward said discharge opening.

5. A developer supply container according to claim 4, wherein said recess is provided at each of a plurality of positions which are asymmetrical with respect to a rotational axis of said container body.

6. A developer supply container according to claim 1, further comprising a plugging member configured and positioned to plug the other longitudinal end of said container body, and wherein an inner surface of said plugging member is provided with a pair of engaging portions configured and positioned to engage between said engaging portions thereof said plate-like member.

7. A developer supply container according to claim 6, further comprising an index mark configured and positioned to align positions of said pair of engaging portions provided at said one longitudinal end of said container body and said pair of engaging portions provided on said plugging member, said index marks being provided on a peripheral surface of said container body at the other longitudinal end and on an outer surface of said plugging member.

8. A developer supply container according to claim 1, wherein said plate-like member is provided with a projection configured and positioned to guide the developer on said plate-like member substantially downwardly toward said discharge opening with the rotation of said container body, wherein said projection is inclined with respect to a rotational axis of said container body.

9. A developer supply container according to claim 8, wherein said projection is provided at each of a plurality of positions on each side of said plate-like member.

10. A developer supply container according to claim 9, wherein said plate-like member has a through-hole, between adjacent ones of the projections, for letting the developer fall from said plate-like member to stir the developer with the rotation of said container body.

11. A developer supply container according to claim 1, wherein said pair of engaging portions are injection-molded engaging portions integrally formed with said container body.

* * * * *

UNITED STATES PATENT AND TRADEMARK OFFICE

CERTIFICATE OF CORRECTION

PATENT NO. : 7,116,929 B2
APPLICATION NO. : 10/833117
DATED : October 3, 2006
INVENTOR(S) : Yusuke Yamada It is certified that error appears in the above-identified patent and that said Letters Patent is hereby corrected as shown below:

ON THE TITLE PAGE, AT ITEM (57), Abstract:
Line 2, “the” should be deleted.

COLUMN 2:
Line 43, “preferred,” should read --preferred--.

COLUMN 3:
Line 31, “by a” should read --by an--.

COLUMN 4:
Line 1, “moved-through” should read --moved through--.

COLUMN 7:
Line 6, “cross-” should read --are cross- --.
Line 54, “potion,” should read --portion,--.

COLUMN 9:
Line 47, “embodiment, and” should read --embodiment,--.

COLUMN 11:
Line 15, “sometime” should read --sometimes--.
Line 34, “ribs id” should read --ribs 1d--.
Line 64, “portion if” should read --portion 1f--.

UNITED STATES PATENT AND TRADEMARK OFFICE

CERTIFICATE OF CORRECTION

PATENT NO. : 7,116,929 B2
APPLICATION NO. : 10/833117
DATED : October 3, 2006
INVENTOR(S) : Yusuke Yamada It is certified that error appears in the above-identified patent and that said Letters Patent is hereby corrected as shown below:

COLUMN 12:
Line 3, "portions if," should read --portions 1f,--.
Line 29, "1 e" should read --1e--.

Signed and Sealed this

Twenty-ninth Day of July, 2008

JON W. DUDAS
*Director of the United States Patent and Trademark Office*